United States Patent [19]

Peddinghaus

[11] Patent Number: 4,545,233

[45] Date of Patent: Oct. 8, 1985

[54] MULTITOOL PUNCHING APPARATUS

[76] Inventor: Rolf Peddinghaus, Deterbergerstr. 25, 5828 Ennepetal, Fed. Rep. of Germany

[21] Appl. No.: 549,927

[22] Filed: Nov. 8, 1983

[30] Foreign Application Priority Data

Nov. 12, 1983 [DE] Fed. Rep. of Germany ..... 3241844

[51] Int. Cl.[4] ..... B21D 22/00; B21J 13/00

[52] U.S. Cl. ..... 72/404; 72/472; 83/552; 29/39

[58] Field of Search ..... 83/550–553; 29/39, 40, 46, 564, 35.5; 72/404, 448, 477, 472

[56] References Cited

U.S. PATENT DOCUMENTS

| | | | |
|---|---|---|---|
| 321,547 | 7/1885 | Towle | 83/552 |
| 626,448 | 6/1899 | Tennant | 83/550 |
| 699,552 | 5/1902 | McLaren | 83/552 |
| 939,958 | 11/1909 | Koelsch | 83/552 |
| 1,749,374 | 3/1930 | Bullard, Jr. | 29/46 |
| 3,279,505 | 10/1966 | Renz et al. | 29/564 |
| 3,830,129 | 8/1974 | Valente | 83/552 |

FOREIGN PATENT DOCUMENTS

| | | | |
|---|---|---|---|
| 2648447 | 4/1978 | Fed. Rep. of Germany | 72/404 |
| 2738344 | 3/1979 | Fed. Rep. of Germany | 72/404 |

*Primary Examiner*—Daniel C. Crane

*Attorney, Agent, or Firm*—Karl F. Ross; Herbert Dubno

[57] ABSTRACT

An apparatus for punching a workpiece has a stationary frame, a longitudinally extending row of horizontally spaced and upwardly facing different dies fixed on the frame below a horizontally elongated punching station, at least one horizontal and stationary rail fixed on the frame, and a punch carriage displaceable horizontally along the rail above the station. A turret rotates about a horizontal turret axis on the carriage and carries a plurality of radially outwardly directed different punches angularly spaced about the turret axis. A positioning unit is operatively connected between the carriage and the frame for displacing the carriage through a plurality of positions in each of which the turret axis is above one of the dies. An indexing unit angularly displaces the turret about its axis through positions in each of which one of the punches is facing down in the station toward the respective die. An actuator vertically displaces the turret and its axis on the punch carriage when one of the punches is above and facing down in the station at the respective die and thereby punches a workpiece resting on the die.

6 Claims, 3 Drawing Figures

MULTITOOL PUNCHING APPARATUS

FIELD OF THE INVENTION

The present invention relates to a punching apparatus. More particularly this invention concerns such an apparatus which carries a plurality of tools, that is punches or stamps and dies or molds.

BACKGROUND OF THE INVENTION

It is known to provide a plurality of tools on a punching or stamping machine so that the machine can do several different punching operations, here meaning two-tool normally metalworking operations and even stamping and embossing. For precision work it is therefore necessary to provide a separate die for each punch, making it necessary to change both of these tools when a different punch is needed.

In a standard arrangement described in German Pat. No. 2,738,344 of K. Blanz an upper punch turret and a similar lower die turret are rotatable about a common vertical axis. The two turrets, constituted as wheels or carousels, are rotationally joined so they can be turned to position an interfitting punch and die in a working station beneath an actuator and above an anvil support. The workpiece is positioned between the wheels in the station and the actuator can push the punch in the station down through the workpiece into the die.

Another arrangement is shown in German Pat. No. 2,648,447 of W. Helkotter and I. Kruse. Here both of the turrets have frustoconical surfaces and are rotated about respective axes inclined to the horizontal to position the tools carried on them in vertical juxtaposition in the punching station.

The problem with both of these arrangements is that they are quite complex. Both of the turrets must be exactly controlled and positioned with respect to each other for perfect punching. This requires extensive position-detecting systems and special servomotor-type actuating arrangements. In addition the bearings of the turrets are frequently heavily loaded during the punching operation, so that these parts must be especially rugged, or provision must be made to brace the turrets during the punching operation.

OBJECTS OF THE INVENTION

It is therefore an object of the present invention to provide an improved multitool punching apparatus.

Another object is the provision of such a punching apparatus which overcomes the above-given disadvantages, that is which is relatively simple and that can be switched from one set of tools to another easily.

SUMMARY OF THE INVENTION

An apparatus for punching a workpiece according to the invention has a stationary frame, a longitudinally extending row of horizontally spaced and upwardly facing different dies fixed on the frame below a horizontally elongated punching station, at least one horizontal and stationary rail fixed on the frame, and a punch carriage displaceable horizontally along the rail above the station. A turret rotates about a horizontal turret axis on the carriage and carries a plurality of radially outwardly directed different punches angularly spaced about the turret axis. A positioning unit is operatively connected between the carriage and the frame for displacing the carriage through a plurality of positions in each of which the turret axis is above one of the dies. An indexing unit angularly displaces the turret about its axis through positions in each of which one of the punches is facing down in the station toward the respective die. An actuator vertically displaces the turret and its axis on the punch carriage when one of the punches is above and facing down in the station at the respective die and thereby punches a workpiece resting on the die.

According to another feature of this invention a link is provided in the indexing means for rotating the turret as the positioner displaces it on the rail in such a manner that each time the turret axis comes above one of the dies the respective punch is moved into position thereover. The angular displacement of the turret is directly related to its longitudinal displacement. This can be done by providing the frame with a stationary horizontal rack and mounting the turret on a shaft centered on the turret axis and carrying a gear meshing with the rack. Thus as the carriage moves horizontally the turret is automatically rotated.

With this arrangement it is therefore necessary to horizontally position the tool carriage, and the proper punch and die pair are automatically brought into registration. Admittedly this moves the exact location where the punching takes place somewhat, but the control technology necessary to take this move into account is minor since the workpiece is normally held by means capable of accurately positioning it. Once the machine is initially set up, with the appropriate dimensioning of the gear, rack, and turret, perfect positioning of the punch and die relative to each other is certain.

According to another feature of this invention means is provided for locking the carriage relative to the frame in any of the relative longitudinal positions thereof. This can be done by forming the carriage or frame with a longitudinal row of transversely open recesses at the same spacing as the dies. A bolt longitudinally nondisplaceable on the other part is engageable in the recesses when same are aligned with it. Typically the recesses are in the carriage and the bolt is on the frame, although the opposite arrangement is also possible.

The dies in accordance with this invention are releasably secured to the frame under the station. Similarly the punches can be releasably secured to the turret. The seats for these tools assure perfect relative positioning.

According to another feature of this invention a stripping element is vertically displaceable in the station under the turret adjacent the punch in use. In addition the turret includes a slide vertically displaceable on the carriage, the turret being journaled in the slide which itself is held in vertical guides on the carriage.

DESCRIPTION OF THE DRAWING

The above and other features and advantages will become more readily apparent from the following, reference being made to the accompanying drawing in which.

SPECIFIC DESCRIPTION

Figure 1:
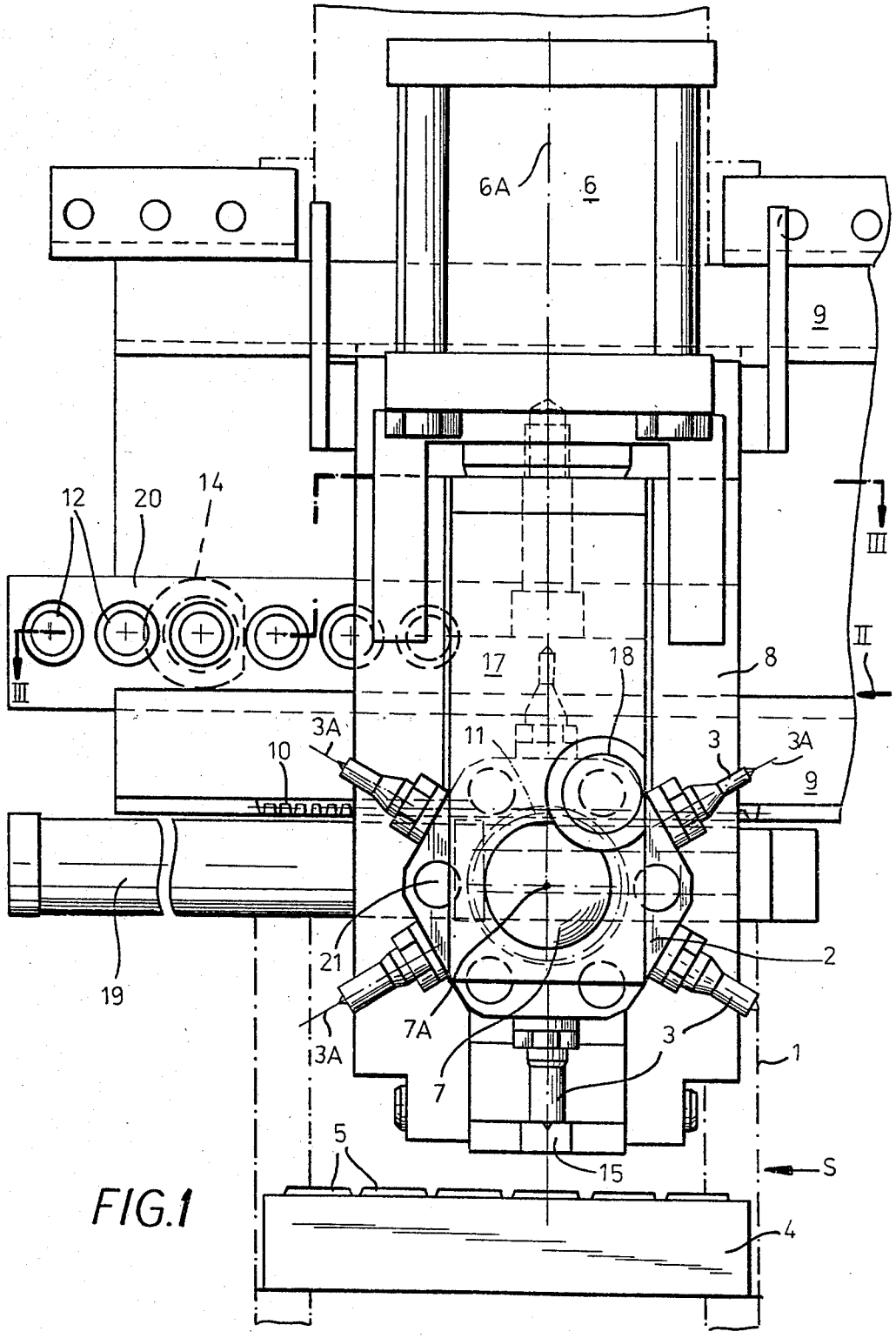
FIG. 1 is a front view of the apparatus according to the invention.
Figure 2:
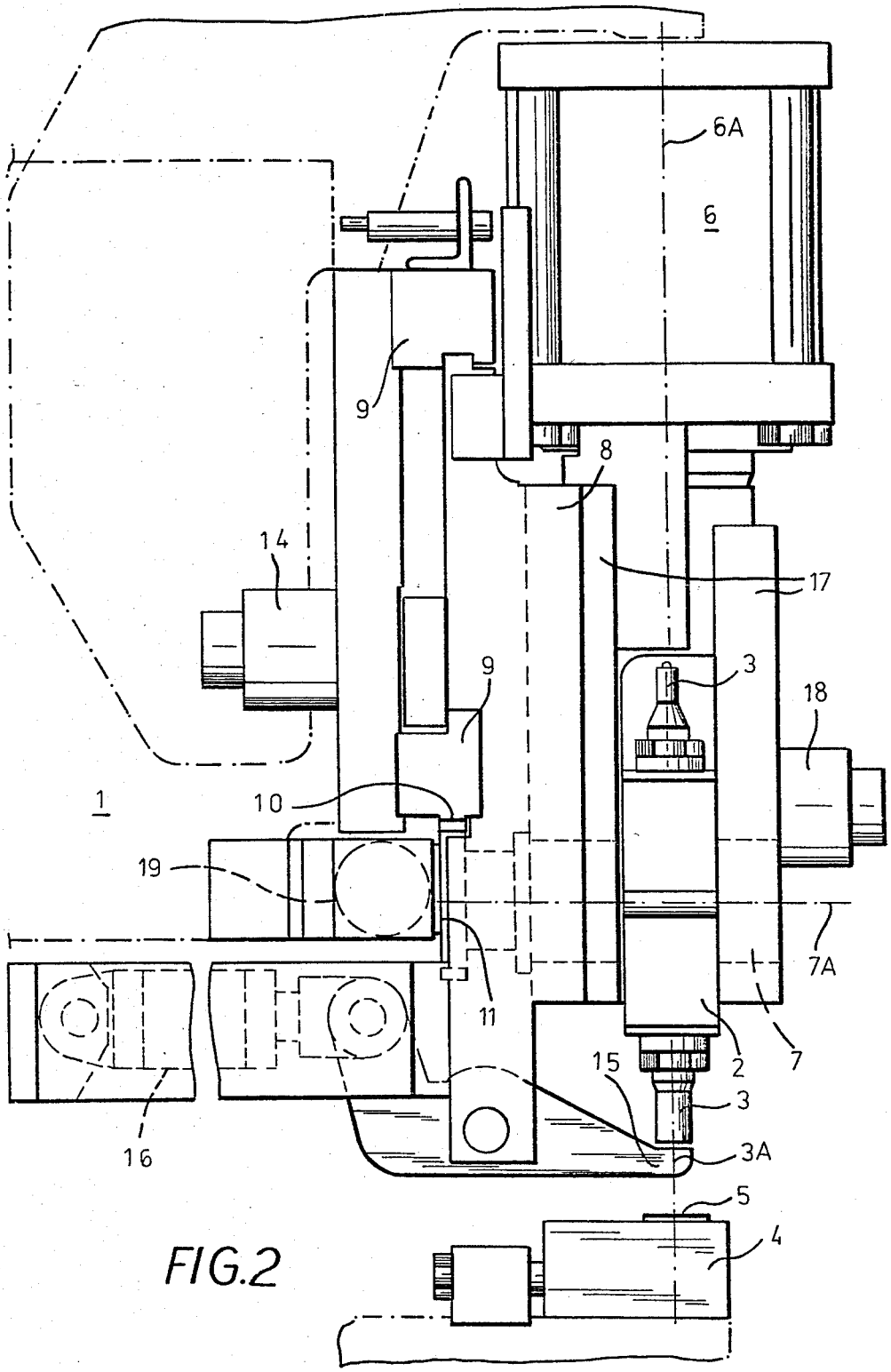
FIG. 2 is a partly diagrammatic end view taken in the direction of arrow II of FIG. 1.
Figure 3:
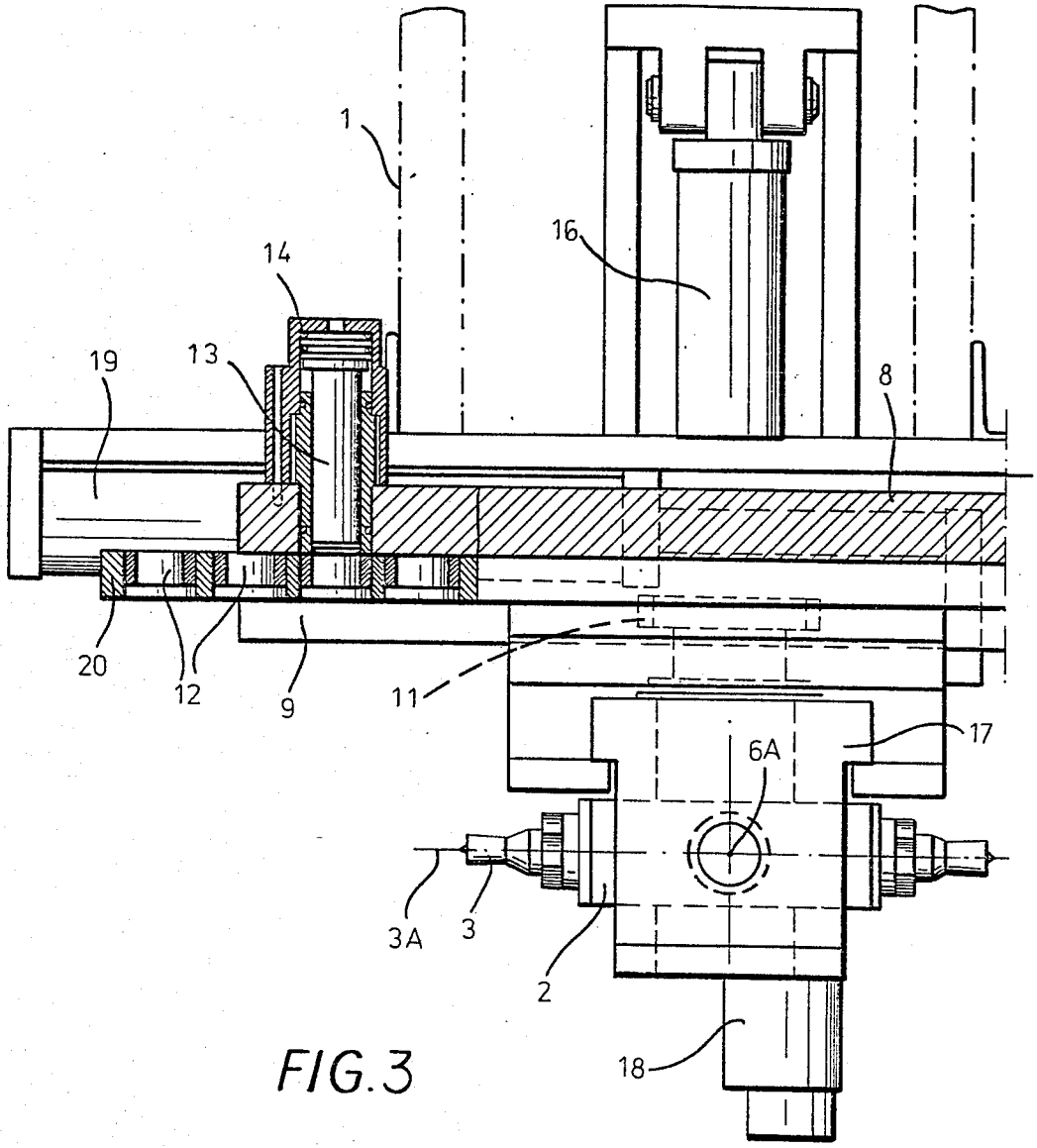
FIG. 3 is a section taken along line III—III of FIG. 1.

As seen in FIGS. 1 through 3 a stationary C-shaped frame 1 has a lower part 4 carrying six different dies 5 that are horizontally equispaced in a row and that define an elongated punching station S. Two vertically superposed but stationary and parallel rails 9 are fixed to the upper part of the this frame 1 and support a tool carriage 8 for horizontal longitudinal movement. A slide 17 is vertically displaceable on this carriage 8 and journals a shaft 7 of a tool turret 2 for rotation about a horizontal shaft axis 7A. This turret 2 carries six different punches 3 centered on axes 3A that are coplanar and that perpendicularly intersect the axis 7A, with the tools 3 angularly equispaced. Each of the tools or punches 3 works with one of the dies 4, normally to punch out a piece.

A heavy-duty double-acting hydraulic ram 6 is carried on the carriage 8 and is connected to the slide 17 so it can displace this slide 17 vertically along an actuator axis 6A that is vertical and that perpendicularly intersects the axis 7A. The shaft 7 carrying the turret 2 carries at one end a gear 11 that meshes with a toothed rack 11 fixed underneath the lower rail 9. A hydraulic cylinder 19 operated by a digital computer-type controller can displace the carriage 8 longitudinally through six positions in each of which the actuator axis 6A extends through a respective one of the dies 4.

The diameter of the gear 11 is such relative to the angular spacing of the punches 3 that as the positioning cylinder 19 moves the carriage 8 from above one die 4 to above the adjacent die 4, the appropriate next punch 3 is moved into perfect position above it.

The carriage 8 has a horizontal longitudinal extension 20 formed with a plurality of recesses or holes 12 spaced identically to the dies 5. The frame 1 carries a pin or bolt 13 that can fit in these holes 12 and that is operated by a cylinder 14. Thus when the turret is prefectly aligned above any of the dies 4, the respective hole 12 will be aligned with the bolt 13 which can be extended forward to lock the carriage against any longitudinal movement on the frame 1.

In addition the turret 2 is formed with six angularly equispaced holes 21 between the punches 3. The slide 17 carries another bolt-cylinder device 18, like the arrangement 13, 14, that can engage in these holes 21 when the turret 2 is perfectly positioned. Thus it is possible to lock these two movable elements constituted by the carriage 8 and turret 2, so that the only motion possible is vertical sliding of the rotationally fixed turret 2 on the carriage 8. The use of a pin extending perpendicular to any force tending to move the respective element being arrested allows very large forces to be controlled easily, while reducing the possibility of loosening.

A cylinder 16 hung underneath the carriage 8 has a stripper 15 that can engage around the lowermost punch 3 to push a workpiece off it.

In use a workpiece is positioned in the station S with its location to be punched, which of course includes stamping or embossing, over the die 5 that has been selected. The cylinder 19 then moves the carriage 8 into position above this die 5, with the proper punch 3 automatically rotating into perfect position thereover.

Then the two bolts 13 and 18 are advanced to lock the carriage 8 on the frame 1 and to lock the turret 2 on the slide 17, and the actuator 6 expands to force the punch 3 down onto the workpiece. Such downward displacement of the slide 8 disengages the gear 11 from the rack 10, but the carriage position is locked, and is not unlocked until the slide 17 has moved back up and reengaged the gear 11 in the rack 10, so that malpositioning is impossible.

Since force flows wholly diametrally through the turret 2, the only stress applied to the bearings supporting the shaft 7 is that necessary to move the slide, which is a modest amount. As a result the system can be extremely simple so it can be used and controlled very easily. Selecting any of the six punch/die sets 2, 4 is as simple as longitudinally positioning the slide 8, something that can be done with great accuracy due to the interfitting bolt 13 and hole 12.

I claim:

1. An apparatus for punching a workpiece, the apparatus comprising;

a stationary frame;

a longitudinal row of horizontally spaced and upwardly facing different dies stationarily fixed on the frame generally below a horizontally elongated punching station;

at least one horizontal and stationary rail fixed on the frame;

a punch carriage displaceable horizontally along the rail generally above the station;

a turret rotatable about a horizontal and transverse turret axis on the carriage and carrying a plurality of radially outwardly directed different punches angularly spaced about the turret axis and each operable only with a respective one of the dies;

positioning means operatively connected between the carriage and the frame for displacing the carriage longitudinally and horizontally through a plurality of positions in each of which the turret axis is directly above one of the dies;

indexing means for angularly displacing the turret about its axis synchronously with the longitudinal and horizontal displacement of the carriage through positions in each of which one of the punches is facing down in the station toward the respective die, the indexing means including a stationary horizontal rack fixed to the frame;

a shaft centered on the turret axis and carrying the turret; and a gear fixed on the shaft and meshing with the rack and of such diameter relative to the angular spacing of the punches about the turret axis that when the carriage moves horizontally the turret is automatically synchronously rotated to align each of the punches directly over the respective die; and actuator means for vertically displacing the turret and its axis on the punch carriage when one of the punches is above and facing down in the station at the respective die and thereby punching a workpiece resting on the die.

2. The punching apparatus defined in claim 1, further comprising means for locking the carriage relative to the frame in any of the relative longitudinal positions thereof.

3. The punching apparatus defined in claim 2 wherein the carriage is formed with a longitudinal row of recesses open toward the frame and at the same spacing as the dies, the locking means including a bolt longitudinally nondisplaceable on the frame and engageable in the recesses when same are aligned with it.

4. The punching apparatus defined in claim 1 wherein the dies are releasably secured to the frame under the station.

5. The punching apparatus defined in claim 1 further comprising a stripping element vertically displaceable in the station under the turret adjacent the punch in use.

6. The punching apparatus defined in claim 1 wherein the turret includes a slide vertically displaceable on the carriage, the turret being journaled in the slide.

* * * * *